US007157114B2

(12) United States Patent
Ackerman et al.

(10) Patent No.: US 7,157,114 B2
(45) Date of Patent: Jan. 2, 2007

(54) PLATINUM COATING PROCESS

(75) Inventors: John F. Ackerman, Laramie, WY (US); Paul V. Arszman, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 550 days.

(21) Appl. No.: 10/674,842

(22) Filed: Sep. 29, 2003

(65) Prior Publication Data

US 2005/0069647 A1 Mar. 31, 2005

(51) Int. Cl.
*B05D 3/02* (2006.01)
*B05D 1/02* (2006.01)

(52) U.S. Cl. ..... 427/229; 427/383.7; 427/427.5

(58) Field of Classification Search ..... 427/229, 427/383.7, 427.5
See application file for complete search history.

(56) References Cited

U.S. PATENT DOCUMENTS

| | | | | |
|---|---|---|---|---|
| 4,427,502 | A | 1/1984 | Abys | 205/242 |
| 5,310,475 | A | 5/1994 | Kitada et al. | 205/67 |
| 5,448,605 | A | 9/1995 | Hettiarachchi | 376/305 |
| 5,494,704 | A * | 2/1996 | Ackerman | 427/237 |
| 6,521,113 | B1 | 2/2003 | Strangman et al. | 205/191 |
| 6,586,046 | B1 | 7/2003 | Ackerman et al. | 427/213 |

FOREIGN PATENT DOCUMENTS

EP 0 989 205 A1 3/2000

JP 08-206517 A * 8/1996

OTHER PUBLICATIONS

Jacobs, G. et al., "Study of preparation parameters of powder and palletized Pt/KL catalysts for n-hexane aromatization", Jan. 22, 2001, pp. 267-282, Applied Catalysis A: General, Elsevier Science, vol. 206, No. 2.

Wei, Z. et al., "Preparation of epitaxial AIN films by electron cyclotron resonance plasma-assisted chemical vapor deposition on IR- and Pt-coated sapphire substrates", Mar. 14, 1994, pp. 1359-1361, Applied Physics Letters, American Institute of Physics, vol. 64, No. 11.

Patent Abstract of Japan, vol. 1996, No. 12, Dec. 26, 1996, and Publication No. 08 206 517 A (Nippon Soken Inc.), Aug. 13, 1996.

Database CA, "Online", Chemical Abstracts Service, Columbus, Ohio, 1976, UVAROVA, N. M. et al., "Study of thermal decomposition of acetylacetonates of platinum(IV) and gold(III) methyl derivatives", retrieved from STN Database accession No. 1978:547043 (abstract).

* cited by examiner

*Primary Examiner*—Fred J. Parker
(74) *Attorney, Agent, or Firm*—Harrington & Smith, LLP

(57) ABSTRACT

A process for depositing pure platinum on a substrate is disclosed. In accordance with one embodiment, the process comprises applying a solution consisting of Pt(acetylacetonate)$_2$ and ethanol or acetone onto a substrate and wrapping at least a portion of the substrate with aluminum foil. The process further comprises heating the substrate wrapped with the aluminum foil to about 300° C. at a rate of about 10–25° C. per minute and then holding at about 300° C. for about 1 hour, wherein the Pt(acetylacetonate)$_2$ decomposes to deposit pure platinum on the substrate.

28 Claims, No Drawings

PLATINUM COATING PROCESS

FIELD OF THE INVENTION

The invention relates to a process for the deposition of pure platinum.

BACKGROUND OF THE INVENTION

Platinum is a dense metal, which is ductile and resistant to high temperature corrosion and oxidation. The properties of platinum make this metal useful in many applications. For example, platinum and platinum alloys are frequently used in the electrical arts for electronic circuits, the chemical arts for catalysts and electrodes, as well as the optical arts for high reflectivity mirrors.

Platinum containing materials also are particularly advantageous for use in high temperature and corrosive environments, such as gas turbine engine operation. In particular, electroplating processes may be employed to deposit a thin layer of platinum on a component prior to diffusion and aluminizing during the production of platinum modified aluminide diffusion coatings.

Chemical vapor deposition processes also may employed to co-deposit platinum with aluminum, as described in commonly assigned U.S. Pat. No. 5,494,704. This patent discloses a useful method to deposit a homogenous biphase mixture of aluminum and platinum on a substrate, such as turbine hardware, by low temperature chemical vapor deposition, thereby providing coverage of internal and external areas of substrate.

However, some prior platinum coating processes suffer from poor deposition uniformity and an undesirable amount of impurities present in the resulting coating after electroplating; platinum losses in the CVD deposition reactor; and inability to produce pure, high temperature platinum coatings. Moreover, current deposition processes for platinum-containing materials often require large capitalization equipment and may not achieve the level of performance needed for some high temperature applications.

Accordingly, there exists a need for a process of depositing pure platinum, which is cost effective, size insensitive and results in uniform deposition of the coating.

BRIEF DESCRIPTION OF THE INVENTION

In one embodiment of the invention, a process for depositing pure platinum on a substrate is disclosed. The process comprises applying Pt(acetylacetonate)$_2$ onto a substrate and wrapping at least a portion of the substrate with metal foil. The process further comprises heating the substrate and metal foil, wherein the Pt(acetylacetonate)$_2$ decomposes to deposit pure platinum on the substrate.

In another embodiment, a process for depositing pure platinum on a substrate comprises applying a solution consisting of Pt(acetylacetonate)$_2$ and ethanol or acetone onto a substrate and wrapping at least a portion of the substrate with metal foil. The process further comprises heating the substrate wrapped with the foil to about 300° C. at a rate of about 10–25° C. per minute and then holding at about 300° C. for about 1 hour, wherein the Pt(acetylacetonate)$_2$ decomposes to deposit pure platinum on the substrate.

According to a further embodiment, a process for depositing pure platinum onto a substrate comprises applying a platinum beta-diketonate onto the substrate and wrapping at least a portion of the substrate with aluminum foil. The process further comprises heating the substrate and aluminum foil to about 300° C. at a rate of about 10–25° C. per minute and then holding at about 300° C. for about 1 hour, wherein pure platinum is deposited on the substrate.

Other embodiments, features and advantages will be apparent from the following more detailed description, which illustrate by way of example the principles of the invention.

DETAILED DESCRIPTION OF THE INVENTION

A process for the deposition of pure platinum is disclosed. The process is cost effective and results in a uniform deposition of the platinum on a variety of substrates.

Pure platinum is used herein to refer to the deposition of platinum in non-alloyed form and substantially free of impurities, such as carbon. For example, the resulting platinum coating may comprise between about 98 and about 99.999 weight % platinum.

An advantage of the present invention is that it may be employed to produce pure platinum coatings on a variety of substrates for many applications. Suitable substrates for use with the present invention include, but are not limited to, nickel-based, cobalt-based, and iron-based alloys, which may be cast or wrought superalloys. More particular examples include GTD-111, GTD-222, Rene 80, Rene 41, Rene 125, Rene 77, Rene 95, Inconel 706, Inconel 718, Inconel 625, cobalt-based HS188, cobalt-based L-605, and stainless steels. Accordingly, the process is especially suited for coating gas turbine engine hardware and parts, such as seals, flaps, turbine blades and vanes, afterburner nozzles, liners and spray bars, flameholders, exhaust centerbodies, and combustor splash plates, etc. The process of the invention also is useful in the production of platinum aluminide bond coats by, for example, overcoating the platinum deposit with a VPA or CVD aluminum layer.

However, additional substrate materials, that can accommodate a pure platinum coating for application other than engine parts, are contemplated by the invention. For example, the invention may be utilized for coatings in marine environments, petrochemical environments, electronic applications, automotive applications and power generators, such as gas, steam and nuclear, among others. Other particularly suitable applications for the pure platinum coatings of the invention include heat rejection mirror coatings, calcium magnesium aluminum silicon (CMAS) mitigation coatings, and coke barrier coatings.

Accordingly, the substrate to which the pure platinum coating is applied may be any suitable substrate, including a metal, metal alloy or a non-metal. For example, the pure platinum coating may be deposited directly onto a base metal substrate. Alternatively, depending upon the desired application, the pure platinum coating may be deposited onto one or more coatings previously applied to a base substrate. For instance, the pure platinum coating may be deposited onto a non-metal material, such as a ceramic thermal barrier coating for use as a heat rejection mirror coating. In this application, the platinum reflects unwanted radiative energy back into a gas stream to keep the turbine hardware cooler. This application is advantageous because electroplating may not be possible with insulating ceramics such as thermal barrier coatings. Other non-metal substrates, such as ceramic smooth coats, ceramic matrix composites and polymeric matrix composites also are contemplated by the invention.

Additionally, the pure platinum coating may be deposited onto a barrier oxide coating, such as silicon oxide, tantalum oxide, etc., which was previously conventionally applied to a base metal substrate. This application is particularly useful if the operating conditions of the article, such as a hot section gas turbine engine component, exceed about 1200–1250° F. because platinum may diffuse into uncoated metals at higher temperatures.

For convenience, the process will be further described with respect to coating the base metal of a gas turbine engine component. However, as described above, the invention is applicable to coat many other substrates. In accordance with an embodiment of the invention, a component, such as a flap or seal, to be coated with pure platinum is provided. If needed, the component may be cleaned prior to the coating process. Suitable cleaning processes include, but are not limited to, wiping the component with a cleansing cloth, submersing the part in an ultrasonic bath, solvent or boiling water, as well other conventional processes.

The deposited platinum may be selected from precursors which are generally platinum beta-diketonates. For example, the preferred compound employed is the organometallic compound, Pt(acetylacetonate)$_2$. We have determined that this compound produces surprisingly superior results not found with use of other metals. For example, palladium acetylacetonate will not react in a like manner to form palladium metal, but will form palladium oxide instead.

In one embodiment, a solution may be prepared by dissolving between about 1 and about 10 g of Pt(acetylacetonate)$_2$ powder in between about 99 ml and about 101 ml of acetone, ethanol or other suitable solvent, such as methanol, methyl ethyl ketone (MEK) or xylene. Preferably, a saturated solution is prepared. The solution then may be uniformly deposited onto the component. For example, the solution may be sprayed onto the component with an airless paint sprayer. Similarly, a syringe may be employed to apply the solution into cavities in the component then drained, and the solvent evaporated before heating.

In another embodiment, a fine powder of Pt(acetylacetonate)$_2$ may be formed by grinding solid Pt(acetylacetonate)$_2$. The component may be dusted with this powder in areas of the component to be uniformly coated with pure platinum. The amount of powder applied to the article will vary depending upon the size of the article. However, a sufficient amount should be deposited so that the powder uniformly covers the substrate. Also, the size of the powder particles may vary, but typically may be between about 1 and about 10 microns.

In a further embodiment of the invention, at least about a 2× stoichiometric (based on the article to be coated) amount of Pt(acetylacetonate)$_2$ may be employed. In this embodiment, the excess reagent may be added to accommodate platinum loss due to the coating of metal foil.

The component then may be wrapped in the metal foil. Preferably, the metal foil is aluminum foil. However, any suitable metal may be employed, including but not limited to copper, iron, molybdenum and nickel. The foil advantageously confines the vapors of the heated reagent to the volume surrounding the hardware to be coated.

Prior to the afore-referenced coating application to the component, conventional masking techniques may be employed to cover areas of the component where the coating of pure platinum is not desired to be deposited. For example, milk of magnesia may be painted onto areas of the hardware where the coating is not desired prior to application of the reagent. Also, if only a portion of the component should be coated, then that portion should be wrapped with the metal foil. Thus, the entire component including external, as well as internal surfaces if applicable, or only a portion of the component may be coated, as desired.

Upon wrapping the part, the edges of the foil around the part preferably should be firmly closed, but not sealed in an airtight fashion by clamping, welding or the like. The size of foil employed will vary depending upon the size of the article to be coated, and thus the foil size may be adjusted, accordingly. For example, the foil may enclose a volume of about 1.2 liters for a piece of hardware with about a 1 liter volume. However, aluminum foil rolls readily available in lengths of about 200 feet may be employed for larger parts. Here, the foils may be wrapped around the part with about 2 inches of overlap at the seams which are then closed before heating. Alternatively, the coated substrate may be enclosed within a conventional non-airtight container, including but not limited to an enclosed metal or non-metal canister, box and part conformal shape. The non-airtight container is such that it may confine the reagent vapors to the volume surrounding the part and allow about 1% by volume of air into the surrounding volume to mitigate carbon.

The foil containing the component or wrapped around a portion of the component, or coated substrate enclosed within the non-airtight container, may then be heated. For example, a furnace, oven or similar heating device may be employed. The component may be heated to the desired temperature such that uniform temperature around the part to be coated is achieved. Heating may be between about 250° C. to about 350° C., more preferably between about 290° C. to about 315° C., and most preferably to about 300° C., at a rate of about 10–25° C. per minute. The temperature is held at the desired temperature for between about ½ hour to about 24 hours, more preferably for about ½ hour to about 5 hours, and most preferably for about one hour. During this process the reagent vaporizes inside of the metal foil or container where it is contained, and then thermally decomposes to form pure platinum and by product gases. By avoiding an airtight seal, such as by merely wrapping the component with foil, we have determined that there is sufficient vapor pressure of oxygen in the enclosed space to oxidize the by products and preclude the formation of carbon impurities. Advantageously, a uniform homogeneous atmosphere of reagent is formed around the part prior to reaching the elevated decomposition temperature by vaporizing the reagent.

The oven then may be de-energized and the component allowed to cool to ambient temperature. Any enclosing foil may be opened and the component, now advantageously uniformly coated with pure platinum, removed for use.

The desired thickness of the resulting coating may vary depending upon the intended application. For example, the resulting coating may have a thickness between about 0.01 and about 10 microns, between about 0.1 microns and about 1 micron, or between about 0.1 to about 0.5 microns, among other thicknesses. The desired thickness and resultant coating uniformity may be achieved, for example, by controlling the quantity of reagent employed or by repeated heatings with lesser quantities of reagent.

The present invention will now be described by way of example, which is meant to be merely illustrative and therefore not limiting.

EXAMPLE

Pure platinum coatings were produced on R41, HS188 and I718 test coupons using the afore-described powder and solution deposition methods. For example, 2"×2"×0.020" R41 test coupons were covered with 1 ml of saturated Pt(acetylacetonate)$_2$/acetone solution, and the acetone was allowed to evaporate. Following reagent application, the entire coupons were wrapped with aluminum foil and placed into a furnace, which was heated to about 300° C. at about 25° C. per minute. After maintaining the 300° C. temperature for about 1 hour, the furnace was de-energized. The coupons were then removed and unwrapped from the foil upon reaching ambient temperature.

Several metal fatigue bar test specimens about 6" in length×0.75" in diameter were similarly coated by applying about 0.2 grams of powder to the fatigue bars. Aluminum foil was then wrapped around a section of each bar to be coated. The bars were placed in a furnace and heated to about 300° C. at about 12° C. per minute. The temperature was then maintained for about 1 hour after which the bars were removed form the furnace and allowed to cool. The foil was then removed from the bars.

A layer of pure platinum coating having a thickness of about 0.3 microns was deposited on each of the above test pieces. Upon inspection by scanning electron microscopy and optical spectroscopy, the coatings showed excellent adhesion, uniformity, density and optical reflection, which is indicative of high quality platinum coatings.

In accordance with embodiments of the invention, a process for depositing pure platinum, which is cost effective and results in uniform deposition of the coating is disclosed. Embodiments of the invention provide a pure platinum deposition that results from stoichiometric decomposition of a platinum reagent, which is applicable to a variety of substrates.

While various embodiments are described herein it will be appreciated from the specification that various combinations of elements, variations or improvements therein may be made by those skilled in the art, and are within the scope of the invention.

What is claimed is:

1. A process for depositing pure platinum on a substrate comprising:

applying Pt(acetylacetonate)$_2$ onto a substrate;

wrapping at least a portion of the substrate with a metal foil; and heating the substrate and the foil, wherein the Pt(acetylacetonate)$_2$ decomposes to deposit pure platinum on the substrate.

2. The process of claim 1, wherein a solution of Pt(acetylacetonate)$_2$ and a solvent selected from the group consisting of acetone, ethanol, methanol, methyl ethyl ketone and xylene is applied onto the substrate.

3. The process of claim 2, wherein the solution is a saturated solution.

4. The process of claim 1, wherein Pt(acetylacetonate)$_2$ in powder form is deposited onto the substrate.

5. The process of claim 1, wherein the substrate and foil are heated to about 300° C. at a rate of about 10–25° C. per minute and then held at about 300° C. for about 1 hour.

6. The process of claim 1, wherein the substrate and foil are heated to a temperature between about 250° C. and about 350° C. and held at the temperature for between about ½ hour and about 24 hours.

7. The process of claim 6, wherein the temperature is between about 290° C. and about 310° C., and is held for between about ½ hour and about 5 hours.

8. The process of claim 1, wherein the pure platinum coating deposited onto the substrate has a thickness between about 0.01 microns and about 10 microns.

9. The process of claim 8, wherein the thickness is between about 0.1 microns and about 0.5 microns.

10. The process of claim 1, wherein a coating is applied over the pure platinum deposited on the substrate.

11. The process of claim 1, wherein the substrate is a gas turbine engine component comprising a base metal.

12. The process of claim 11, wherein the substrate is selected from the group consisting of a nickel-based alloy, a cobalt-based alloy, and an iron-based alloy.

13. The process of claim 11, wherein a pure platinum coating is deposited onto a coating previously applied to the base metal.

14. The process of claim 11, wherein the substrate is selected from the group consisting of a seal, flap, vane, blade, combustor splash plate and flameholder.

15. The process of claim 1, wherein the substrate is selected from the group consisting of a metal, metal alloy, and non-metal material.

16. The process of claim 1, wherein the pure platinum is employed as part of a coating selected from the group consisting of a heat rejection mirror coating, a coke barrier coating and a calcium magnesium aluminum silicon barrier coating.

17. The process of claim 2, wherein the solution is sprayed onto the substrate.

18. The process of claim 1, wherein the entire substrate is wrapped in the foil.

19. The process of claim 1, wherein the foil is aluminum foil.

20. A process for depositing pure platinum on a substrate comprising:

applying a solution selected from the group consisting of 1) Pt(acetylacetonate)$_2$ and ethanol and 2) Pt(acetylacetonate)$_2$, and acetone onto a substrate;

wrapping at least a portion of the substrate with a metal foil;

heating the substrate wrapped with the foil to about 300° C. at a rate of about 10–25° C. per minute and then holding at about 300° C. for about 1 hour, wherein the Pt(acetylacetonate)$_2$ decomposes to deposit pure platinum on the substrate.

21. The process of claim 20, wherein the substrate is a gas turbine engine component.

22. The process of claim 20, wherein the foil is aluminum foil.

23. A process for depositing pure platinum on a substrate comprising:

applying a solution of Pt(acetylacetonate)$_2$ onto a substrate;

wrapping at least a portion of the substrate with aluminum foil; and heating the substrate and foil, wherein the Pt(acetylacetonate)$_2$ decomposes to deposit pure platinum on the substrate.

24. The process of claim 23, wherein the substrate and the foil are heated to about 300° C. at a rate of about 10–25° C. per minute and then held at about 300° C. for about 1 hour, wherein the Pt(acetylacetonate)$_2$ decomposes to deposit pure platinum on the substrate.

25. A process for depositing pure platinum onto a substrate comprising:

applying a platinum beta-diketonate onto the substrate;

wrapping at least a portion of the substrate with aluminum foil; and heating the substrate and aluminum foil to about 300° C. at a rate of about 10–25° C. per minute and then holding at about 300° C. for about 1 hour, wherein pure platinum is deposited on the substrate.

26. The process of claim 25, wherein the substrate is a gas turbine engine component.

27. A process for depositing pure platinum on a substrate comprising:

applying Pt(acetylacetonate)$_2$ onto a substrate;

enclosing the substrate within a non-airtight container; and heating the substrate and the non-airtight container, wherein the Pt(acetylacetonate)$_2$ decomposes to deposit a pure platinum coating on the substrate, which is a gas turbine engine component.

28. The method of claim 27 wherein the pure platinum coating is selected from the group consisting of 1) a bond coating deposited on the component and having a layer of aluminum thereon and 2) a pure platinum coating deposited onto a baffler oxide coating located on the substrate, which is a base metal substrate of the gas turbine engine component.

* * * * *